US008177028B2

(12) United States Patent
Durkin

(10) Patent No.: US 8,177,028 B2
(45) Date of Patent: May 15, 2012

(54) LADDERWAY SYSTEM FOR UNDERGROUND RAISES

(75) Inventor: Steven Peter Durkin, Boulder (AU)

(73) Assignee: Bortana Pty. Ltd., Boulder, Western Australia (AU)

( * ) Notice: Subject to any disclaimer, the term of this patent is extended or adjusted under 35 U.S.C. 154(b) by 1127 days.

(21) Appl. No.: 11/720,811

(22) PCT Filed: Dec. 2, 2005

(86) PCT No.: PCT/AU2005/001815
§ 371 (c)(1), (2), (4) Date: Jun. 4, 2007

(87) PCT Pub. No.: WO2006/058380
PCT Pub. Date: Jun. 8, 2006

(65) Prior Publication Data

US 2009/0229915 A1 Sep. 17, 2009

(30) Foreign Application Priority Data

Dec. 3, 2004 (AU) ..... 2004906913

(51) Int. Cl.
*E06C 1/34* (2006.01)

(52) U.S. Cl. ..... 182/106; 182/128

(58) Field of Classification Search ..... 182/106, 182/128
See application file for complete search history.

(56) References Cited

U.S. PATENT DOCUMENTS 3,455,414 A * 7/1969 Higgins ..... 182/106
3,618,702 A * 11/1971 Hendrix et al. ..... 182/93
3,745,738 A * 7/1973 Singer ..... 52/741.3
4,524,848 A * 6/1985 Russo ..... 182/77
4,660,334 A 4/1987 McCarthy
4,991,690 A * 2/1991 Woller ..... 182/93
5,398,477 A * 3/1995 Philipp et al. ..... 52/848
2004/0261343 A1* 12/2004 Koteskey ..... 52/481.1

FOREIGN PATENT DOCUMENTS

| | | | |
|---|---|---|---|
| DE | 198 08 144 | A1 | 9/1999 |
| JP | 2000303774 | | 10/2000 |
| JP | 2001164856 | | 6/2001 |
| JP | 2002038504 | A | 2/2002 |
| SU | 1067218 | A | 1/1984 |
| SU | 1182848 | A | 4/1987 |
| WO | WO 95/06185 | | 3/1995 |

OTHER PUBLICATIONS

International Search Report mailed Jan. 9, 2006.
Written Opinion mailed Jan. 9, 2006.
International Preliminary Report on Patentability mailed Oct. 25, 2006.

* cited by examiner

*Primary Examiner* — Alvin Chin Shue
(74) *Attorney, Agent, or Firm* — Nixon & Vanderhye P.C.

(57) ABSTRACT

A ladderway system for an underground raise includes an elongate tube adapted to generally conform to the shape of the raise. The tube is of circular cross-section to generally conform to the shape of a round bored raise. The tube is formed with a longitudinal slit along its entire length, whereby the diameter of the tube can be adjusted to generally conform to the shape of the raise. The ladderway system further includes a ladder adapted to be mechanically coupled to an interior of the tube. The tube is manufactured of a sufficiently rigid and strong plastics material, such as polyurethane, so that it acts as a surface membrane or liner within the raise.

10 Claims, 6 Drawing Sheets

LADDERWAY SYSTEM FOR UNDERGROUND RAISES

This application is the U.S. national phase of International Application No. PCT/AU2005/001815 filed 2 Dec. 2005 which designated the U.S. and claims priority to Australian Patent Application 2004-906913 filed 3 Dec. 2004, the entire contents of each of which are hereby incorporated by reference.

FIELD OF THE INVENTION

The present invention relates to a ladderway system for underground raises and relates particularly, though not exclusively, to a ladderway system for underground mine development.

BACKGROUND TO THE INVENTION

Underground mines are required to provide ventilations raises, which may also serve as emergency escape raises through which underground miners can escape to the surface in the event of an emergency. For this purpose it is common for such underground escape raises to be provided with a ladderway to permit miners to climb up out of the mine. Conventional ladderways are typically in the form of a prefabricated steel ladder surrounded with a steel mesh caging to provide a measure of protection for the miners as they climb the ladder.

Apart from the fact that such steel ladderways are heavy and expensive to manufacture and install, they are also difficult and expensive to maintain. The ladderway is constantly exposed to groundwater and seepage which contribute to corrosion, particularly in highly saline groundwater conditions. Hence such steel ladderways require regular maintenance to ensure that salt and rust forming on the ladder rungs are cleaned away. It is difficult to ascertain to what extent the steel has corroded over time and the safety of the ladderway is compromised. Furthermore, the steel mesh cage does not provide adequate protection for miners from rock falls.

The present invention was developed with a view to providing a ladderway system that provides improved safety for miners escaping through a raise from an underground mine, but may also be applicable in other situations where a ladderway is required to provide an escape way in a relatively confined space.

References to prior art in this specification are provided for illustrative purposes only and are not to be taken as an admission that such prior art is part of the common general knowledge in Australia or elsewhere.

SUMMARY OF THE INVENTION

According to the present invention there is provided a ladderway system for an underground raise, the system comprising:

an elongate tube adapted to generally conform to the shape of the raise;

a ladder adapted to be mechanically coupled to an interior of said tube and extending substantially the full length of the tube; and a mounting means for mounting the ladder and the tube to a wall of the raise, wherein the tube acts as a liner for the raise to protect a person on the ladder.

Preferably said system is a modular system and comprises a plurality of said elongate tubes adapted to be joined end to end in the raise, each tube having a ladder and mounting means for mounting the ladder and the tube to a wall of the raise. Preferably each of said tubes is tapered at one end so that the ends of adjacent tubes can overlap when joined end to end. Typically the ladder in each tube is provided with joining means for joining the ladders in adjacent tubes end to end.

Preferably said mounting means is provided in connection with the ladder

Advantageously said elongate tube is of circular cross-section and is formed with a longitudinal slit along its entire length whereby the diameter of the tube can be adjusted to generally conform to the shape of the raise. Preferably the ladder is used as a means of locking the tube in place. Preferably the ladder is received in a gap formed between the edges of the longitudinal slit and pushes the tube outwards to conform to the shape of the raise.

Typically the tube is made of resilient plastics material and may optionally be fire retardant. The ladder is typically also made of a suitable plastics material.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention. Furthermore, throughout the specification, unless the context requires otherwise, the word "raise" will be understood to refer to any vertical or angled underground development opening or shaft that can be used for ventilation, materials handling or as a manway including, but not limited to, winzes and rises.

BRIEF DESCRIPTION OF THE DRAWINGS

The nature of the invention will be better understood from the following detailed description of preferred embodiments of the ladderway system, given by way of example only, with reference to the accompanying drawings, in which.

DETAILED DESCRIPTION OF PREFERRED EMBODIMENTS

The words "rise" and "raise" are typically used interchangeably to refer to angled underground mine shafts, however in the Western Australian mining industry the words are used to describe slightly differing methods of raise development. Raises can be developed on any angle from around 35° to vertical. Ladders should preferably be no more than 75° to reduce upper body fatigue when climbing them. Other than these limitations the raises can be driven at various angles dependent on the orientation of the ore body and other mine design criteria. If, for example, a mine has two escape rises, one 55° (dip), the other 75° and steel caged ladders were to be used, the steel cages and rest platforms would be designed and manufactured with slightly different angles to allow for ease of use. Most raises are typically angled at between 60° and 80°. Raises are typically excavated by explosives or by drilling (boring). Larger holes are more expensive and therefore most mines design rises to keep within certain specified dimensions.

Figure 1:
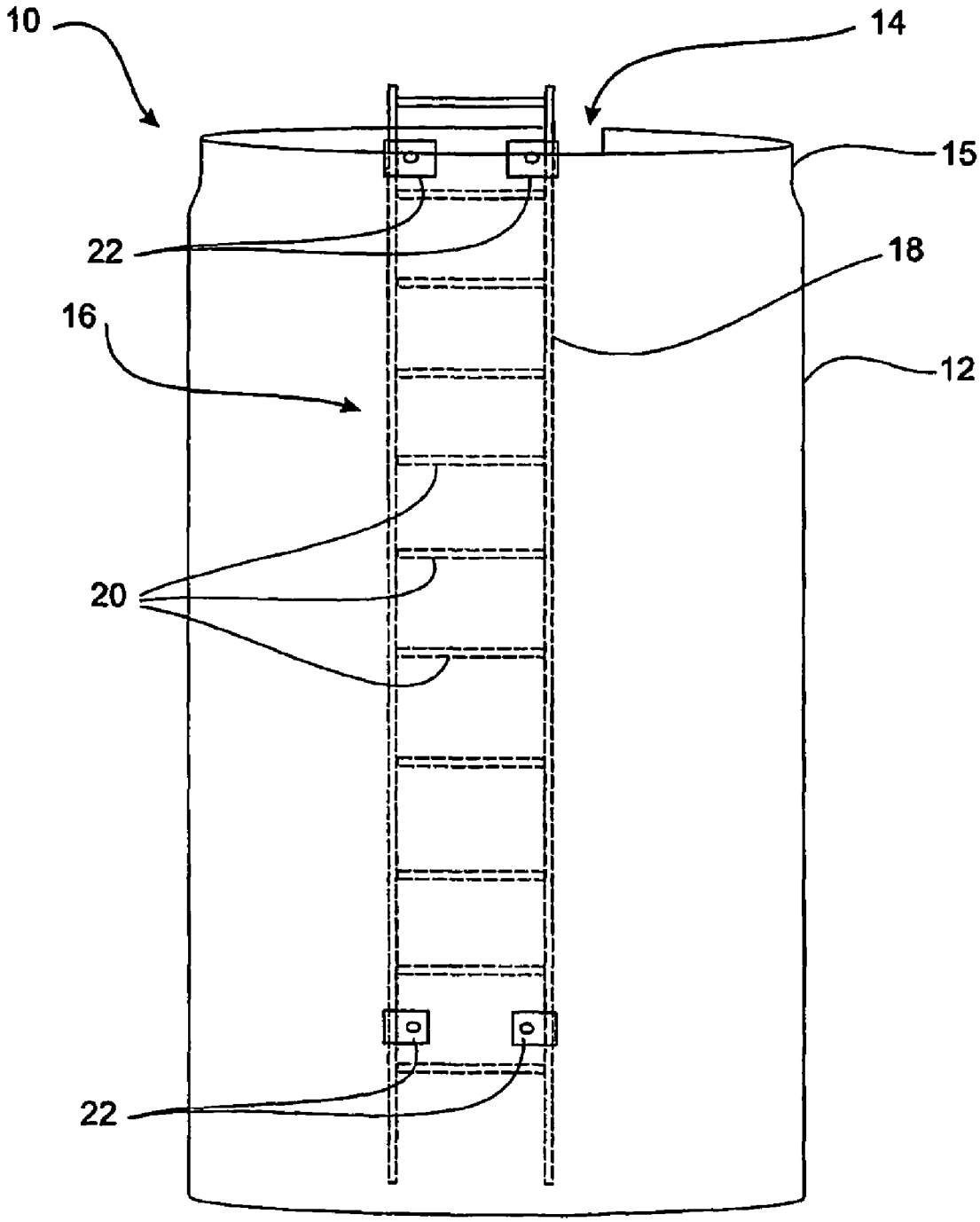
FIG. 1 is a schematic diagram illustrating a first embodiment of the ladderway system according the present invention in side elevation.
Figure 2:
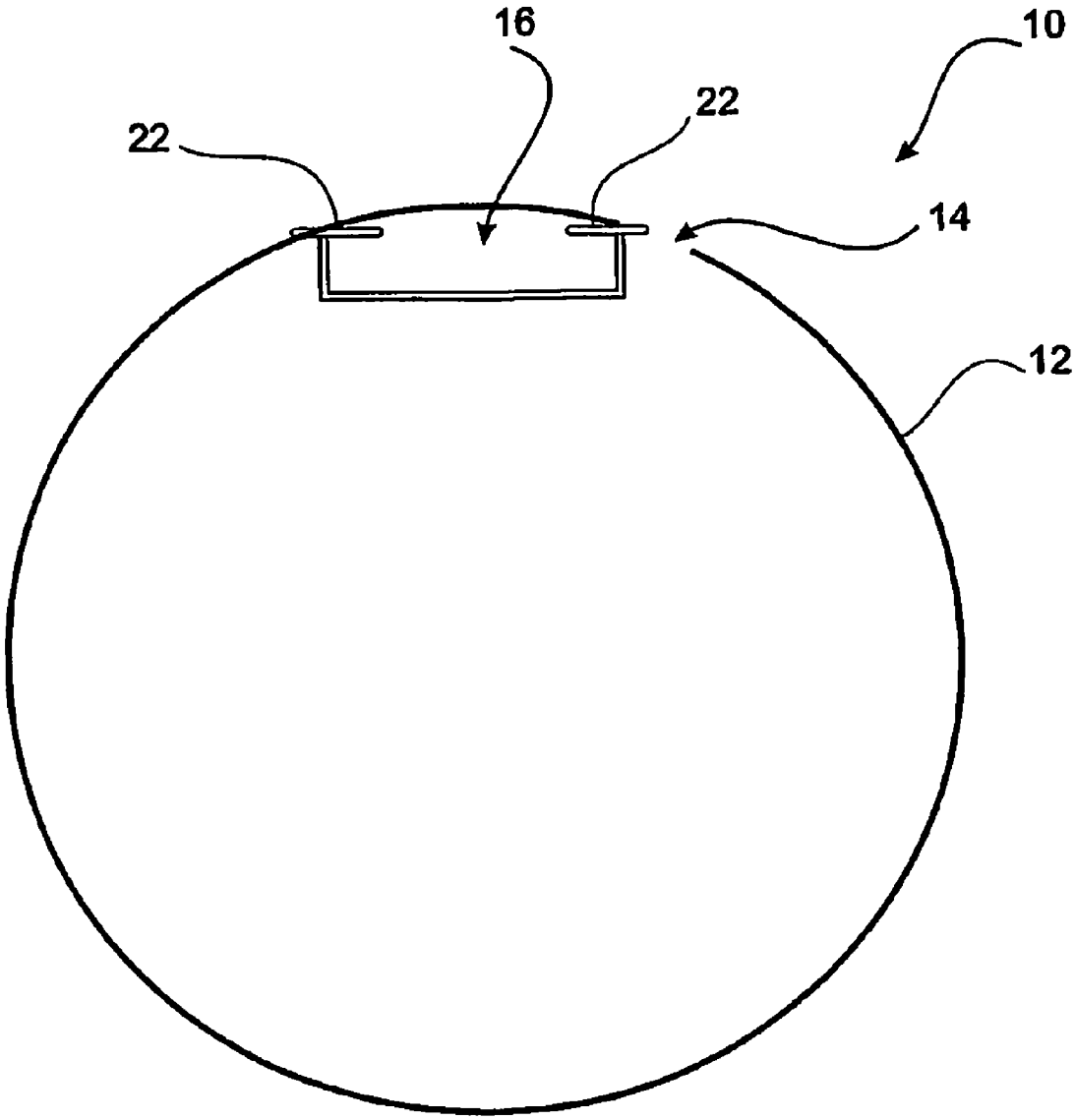
FIG. 2 is a plan view of the ladderway system of FIG. 1.

A first embodiment of a ladderway system 10 for an underground raise (not shown), as illustrated in FIGS. 1 and 2, comprises an elongate tube 12 adapted to generally conform to the shape of the rise. In this embodiment the tube 12 is of circular cross-section to generally conform to the shape of a round bored raise approximately 1 m in diameter. However, it will be understood that the tube 12 may be of any desired cross-sectional shape. The tube 12 is formed with a longitudinal slit 14 along its entire length, as can be seen most clearly in FIG. 2, whereby the diameter of the tube 12 can be adjusted to generally conform to the shape of the raise. The ladderway system 10 further comprises a ladder 16 adapted to be mechanically coupled to an interior of the tube 12.

Preferably the tube 12 is made of resilient plastics material. The tube is typically installed in a relaxed state, with its diameter reduced so as to be more easily received in the rise, and when the ladder 16 is installed the tube 12 is pushed out to press firmly against the wall of the raise. The tube 12 is manufactured of a sufficiently rigid and strong plastics material, such as polyurethane, so that it acts as a surface membrane or liner, preventing rocks and soil from coming loose and damaging the ladderway or exposing personnel on the ladder 16 to unnecessary risks.

The plastic tube 12 may also act as a water jacket keeping all groundwater and seepage out of the escape way, thereby improving comfort levels for personnel and reducing the likelihood of salt build-up and corrosion. Preferably each of the tubes 12 is tapered 15 at the top end so that the ends of adjacent tubes can overlap when joined end to end. The overlapping join of the tubes 12 inhibits the ingress of water into the interior of the ladderway.

The ladder 16 in this embodiment is preferably mechanically anchored to an internal surface of the tube 12 and extends substantially the full length of the tube 12. The ladder 16 comprises a rack 18 having two elongate, parallel members between which the rungs 20 are fixed. The rack 18 is manufactured from a strong rigid plastics material and is designed to have a structural capacity to support the weight of the entire string of ladderway modules during installation.

The rungs 20 are typically round in cross-section with a 30 mm diameter, and may also be of solid plastic construction or plastic coated steel tube. Mounting means in the form of brackets 22 are provided in connection with the ladder 16, for securely mounting the ladder 16 and the tube 12 to a wall of the raise. Suitable rock bolts (not shown) are received through the mounting brackets 22 and driven into the wall of the raise. Typically the ladder 16 in each tube 12 is provided with joining means in the form of joining brackets 24, as can be seen most clearly in FIG. 3, for joining the ladders 16 in adjacent tubes end to end. One side of the slit 14 of the tube 12 is fixed to the ladder 16 and the other side is free to move prior to installation.

Figure 3:
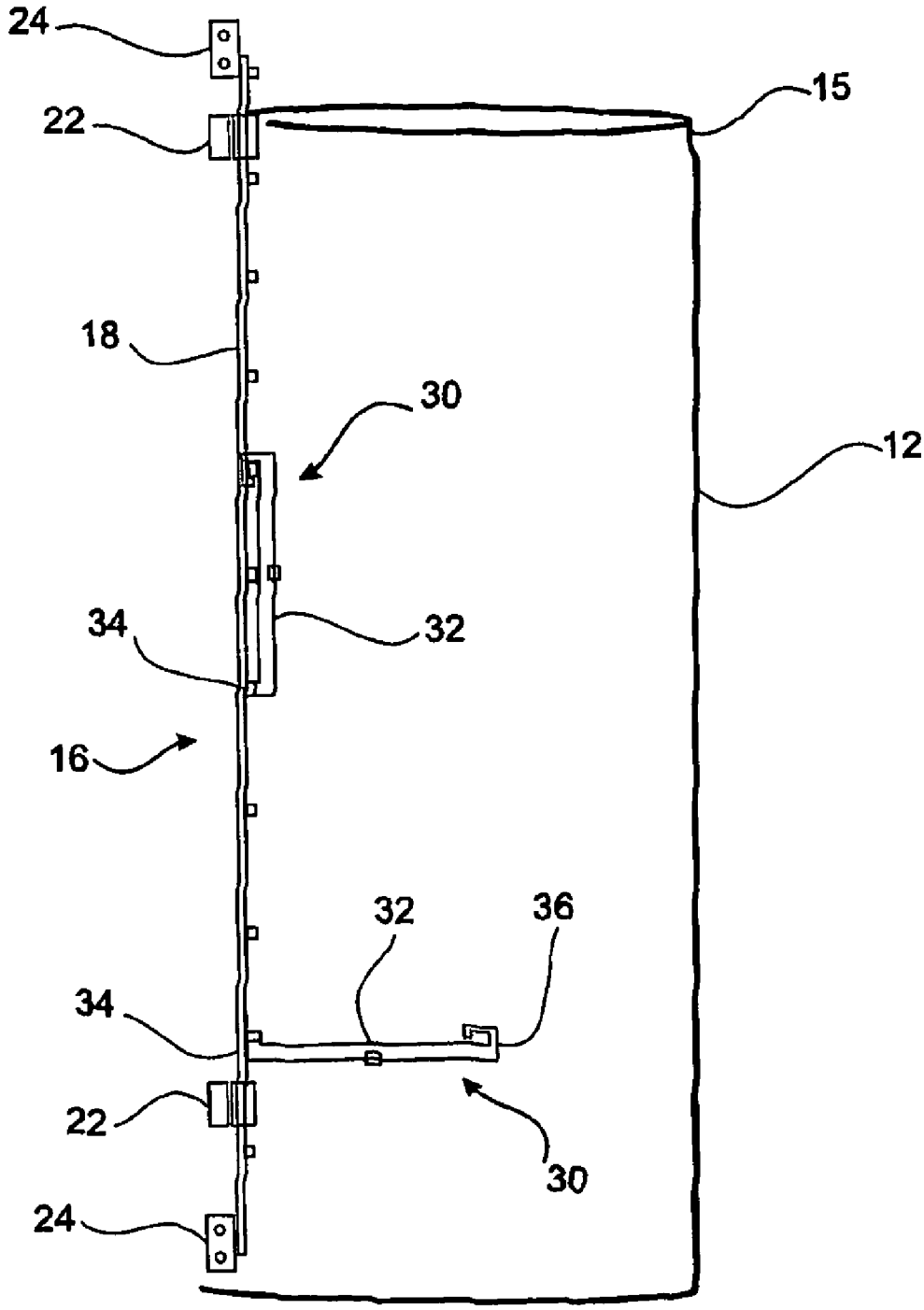
FIG. 3 is a profile view of the ladderway system of FIG. 1, showing the position and operation of a rest platform.

Advantageously the ladderway system 10 also includes a plurality of rest platforms 30, typically provided in connection with the ladder 16, as illustrated in FIG. 3. The rest platform 30 comprises a deck 32 sufficiently large for a single person to sit or stand on, which is typically pivotally connected to the ladder 16 by a hinge connection 34. The hinge connection 34 permits the rest platform 30 to pivot from a stowed position as shown midway in FIG. 3, to an open horizontal position as shown towards the bottom of FIG. 3.

The ladderway of FIG. 3 is shown with two rest platforms 30 in relatively close proximity, however in practice they would be spaced apart by a greater distance. The deck 32 is provided with a hook 36 for securing the platform to a rung of the ladder 16 in its stowed position. The deck 32 is specially designed to allow for any angle raise, thereby reducing requirements for specially manufactured ladders depending on raise dip. Once the ladders are installed the rest platforms are put in place and a part of the hinge is cut to the relevant angle for the raise to allow for a sub-horizontal deck once in the lowered position. This being the case, the only requirement for differently angled raises is that a shallower angle would require a larger tube and therefore a larger hole. In practice, most raises are designed with a minimum diameter.

A preferred method of installing the ladderway system 10 will now be briefly described with reference to the accompanying drawings. A suitable underground raise is firstly excavated. In view of the design of the ladderway system 10 the raise can of reduced diameter, since the risk of rock-fall or cave-in is substantially eliminated by the provision of tube 12. Hence the cost of excavating or boring the escape/ventilation raise can also be significantly reduced.

In the illustrated embodiment the rise is about 1 m in diameter. The ladderway system 10 is prefabricated in the factory and therefore each module only needs to be lowered into the raise and secured in place. The modules are custom designed for the raise, and hence in this case are designed so that in its relaxed state the tube of each module will be smaller than 1 m in diameter. During installation the free side of the slit 14 in the tube 12 is tied to the ladder 16 such that the outer diameter of the tube 12 is less than the diameter of the raise, thereby facilitating ease of installation. The first module is lowered into the raise to the bottom end of the raise and, once in position, the ties holding the free side of the slit 14 are released to allow the plastic tube 12 to spring out to give a close fit to the rock wall of the raise. Preferably the circumference of the tube 12 is selected so that the edges of the two sides of the slit 14 will still slightly overlap, even in the expanded position.

The ladder 16 is then bolted into position in the raise with the tube 12 by means of the mounting brackets 22. As the bolts (not shown) also pass through the free side of the slit 14 of the tube, the tube diameter is now fixed and the tube effectively acts as a barrier between the rock wall of the raise and the interior of the ladderway. A second module of the ladderway system 10 is lowered into the raise in a similar manner to the first, to a position just above the first. The ties on this second module are likewise released and the second tube 12 is slid downwards so that the bottom edge of the tube is received in overlapping relation with the taper 15 of the first tube.

The ladder 16 of the second module is aligned with the ladder of the first module and the two ladders are joined end to end by means of the joining brackets 24. The ladder 16 and tube 12 of the second module may then be secured to the wall of the raise in a similar manner to the first module, using the mounting brackets 22 provided for this purpose. Alternatively, securing of the second module may be postponed until subsequent modules have been installed, since the ladder 16 of the first module is strong enough to support the other modules (which are all relatively lightweight). Installation of subsequent modules follows the same procedure as for the second module.

The process of installation can also be done from underneath thereby pushing the first module up to the bottom collar of the raise, holding in position while the next module is put in place and bolted together, etc. It is envisaged that both methods would be developed and used depending on site requirements.

The final stage in the installation process typically involves installation and fitting of the rest platforms 30 at desired intervals.

Figure 4:
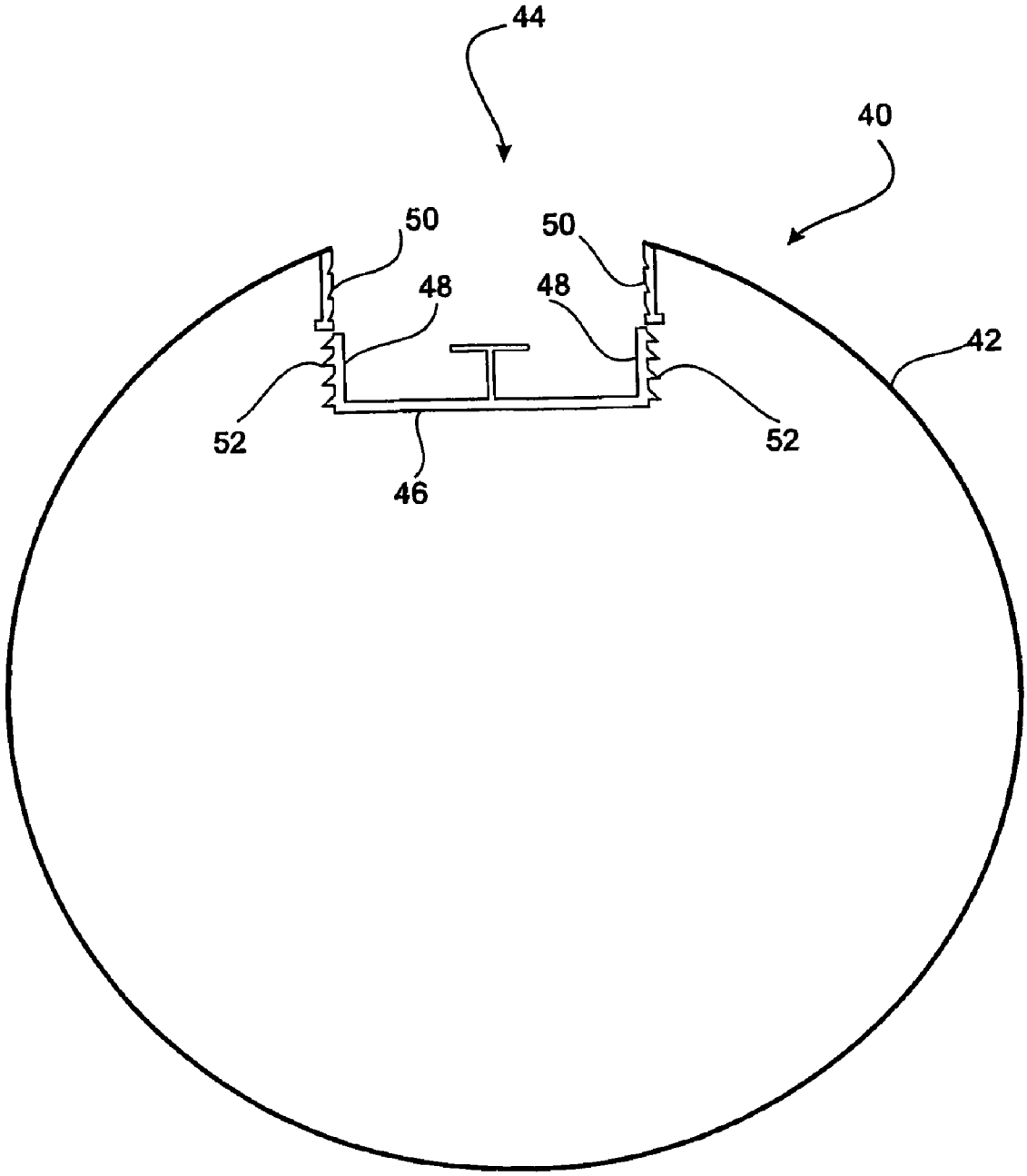
FIG. 4 is schematic diagram illustrating a second embodiment of the ladderway system according the present invention in plan view during installation.
Figure 5:
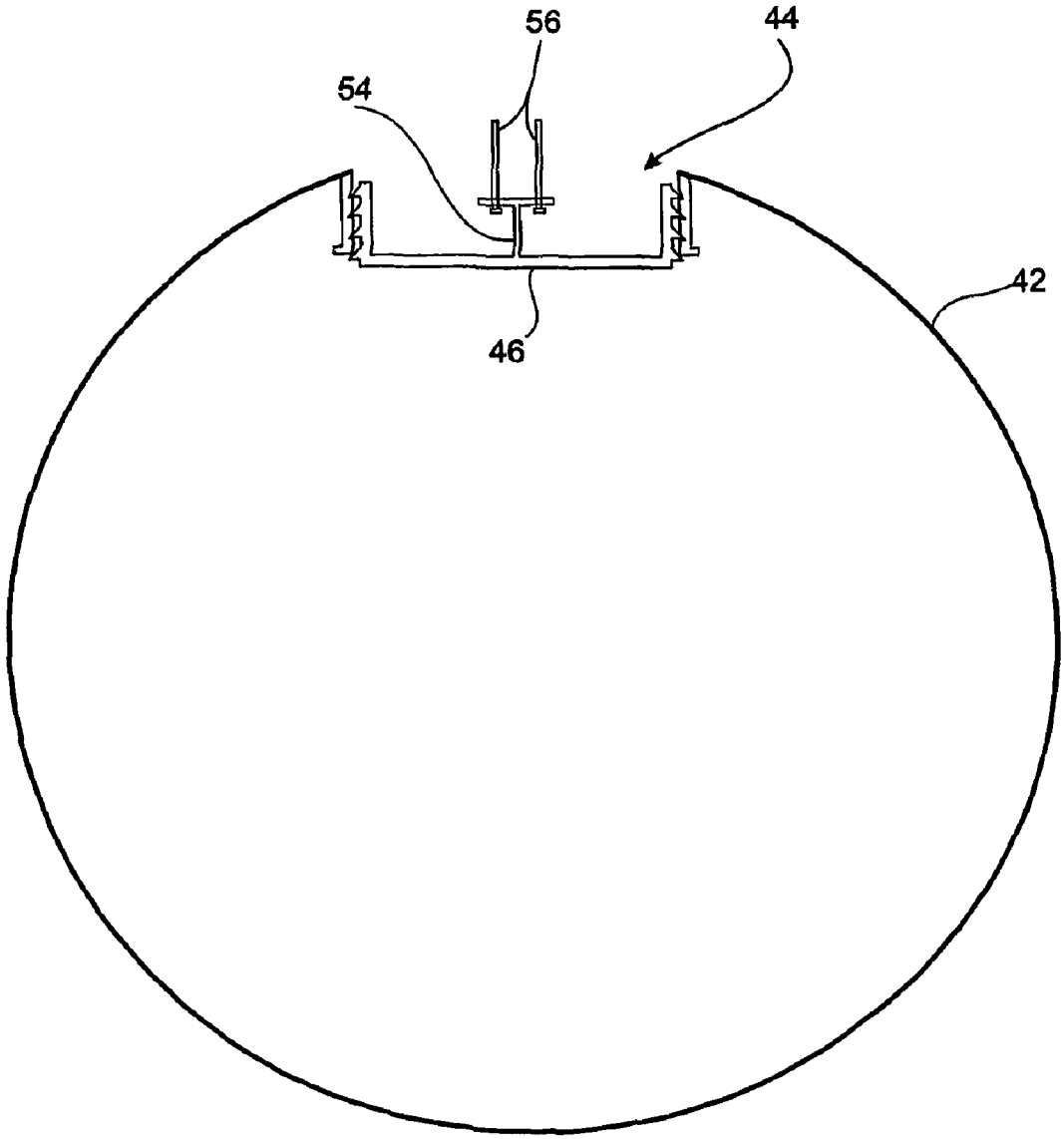
FIG. 5 illustrates the ladderway system of FIG. 4 fully installed.
Figure 6:
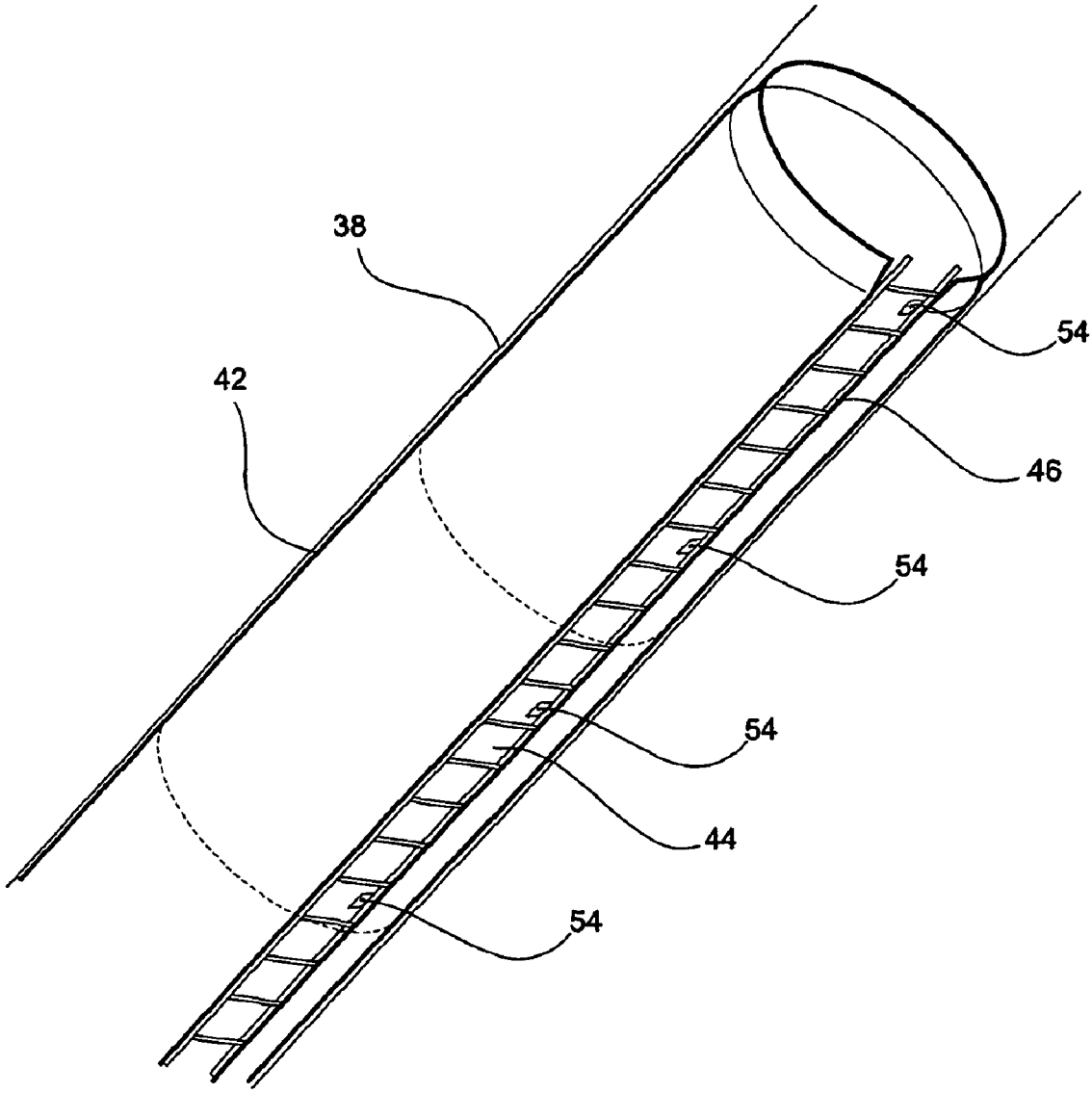
FIG. 6 is a perspective view of a ladderway system according to the present invention installed in a raise.

A second embodiment of a ladderway system 40 for an underground raise will now be described with reference to FIGS. 4 to 6. The ladderway system 40 comprises an elongate tube 42 adapted to generally conform to the shape of the rise. In this embodiment the tube 42 is also of circular cross-section to generally conform to the shape of a round bored raise. However, it will be understood that the tube 42 may also be of any desired cross-sectional shape. As in the previous embodiment, the tube 42 is formed with a longitudinal slit 44 along its entire length, as can be seen most clearly in FIGS. 4 and 5, whereby the diameter of the tube 12 can be adjusted to generally conform to the shape of the raise. However, in this embodiment the slit 44 is of larger width so that even when the tube 42 is installed a significant gap remains between the edges of the two sides of the slit 44.

The ladderway system 40 further comprises a ladder 46 adapted to be mechanically coupled to an interior of the tube 42. In this embodiment the ladder 46 has two elongate side members 48 designed to engage with a respective keyway surface 50 welded on the two edges of the slit 44 (see FIG. 4). The ladder side members 48 are preferably formed with a series of protruding ratchet ribs 52 which are received in matching recesses provided in the keyway surfaces 50. The size of the gap between the two edges of the slit 44 is designed to accommodate the width of the ladder 46 with the tube 42 in its fully expanded position. Each ladder 46 is preferably also provided with a plurality of support brackets 54 at spaced intervals along the length of the ladder for connecting the ladder 46 to a wall of the raise. Suitable fasteners, such us bolts 56, are provided for fastening the support brackets to the wall of the raise (see FIG. 5).

Preferably the tube 42 is made of resilient plastics material. The tube is typically installed in a relaxed state, with its diameter reduced so as to be more easily received in the rise, and when the ladder 46 is installed between the keyway surfaces 50, the tube 42 is pushed out to press firmly against the wall of the raise. The tube 42 is manufactured of a sufficiently rigid and strong plastics material, such as polyurethane, so that it acts as a surface membrane or liner within the raise as shown in FIG. 6. The tube 42 is preferably installed with the ladder 46 located at the bottom of the slope so that the only exposed face of the raise 38, (behind the ladder 46), is at the lowest point of the incline (see FIG. 6). Any water, rocks or other debris that may be loose cannot fall any lower and will simply flow down the exposed face or foot wall of the raise 38 behind the ladder.

A preferred method of installing the ladderway system 40 will now be briefly described with reference to the accompanying drawings. A suitable underground raise is firstly excavated. The ladderway system 40 is pre-fabricated in the factory in modular form and therefore each module only needs to be lowered into the raise and secured in place. The tube 42 of the system will be installed first by placing one section at the top of the raise, attaching the second section to it and lowering the already connected sequence enough to attach a third section, and so on, until the length of the raise is completely filled with the connected sequence of outer tubing.

Preferably a device is provided (not illustrated) that will allow the sequence of tubes 42 to be lowered using a steel wire cable that effectively supports the entire weight of the column without placing undue stress on the plastic tubing. Once in place the steel wire cable will be tied off so that the ladders 46 can be lowered into position. All of the ladder sections 46 are connected to each other using some form of poly-welding and are lowered sequentially, as above, until all the ladders 46 are in place along the full length of the raise. Preferably the ladders 46 will be lowered by a second steel wire cable that may or may not become integral to the final structure of the ladderway 40.

Once in place, the cable holding the ladders 46 will be tied off at the top of the raise and a person with appropriate working-at-heights safety equipment will enter the raise from the top and begin the process of bolting the ladders 46 to the footwall of the raise by means of the support brackets 54. This process, in turn, involves locating the tube 42 with a type of graduated ratchet connection that pushes the edges of the slit 44 apart as the ladders 46 are secured to the footwall of the raise. Once the full length of ladderway is in place, the resting platforms will be installed and the installation is complete.

There is potential for locating brackets to be added to the ladders for supporting a poly pipe for compressed air/pump line/water line to be installed within the raise, without fear of it interfering with the egress of personnel through the ladderway.

The prescribed number, diameter and length of modules of the ladderway system will be custom designed and prefabricated for a particular raise. Each module of the system is typically 3 m in length, however clearly the modules can be manufactured to any desired length.

Now that preferred embodiments of the ladderway system have been described in detail, it will be apparent that it has a number of advantages compared to prior art systems, including the following:

(i) Due to its relatively lightweight construction it is easier to install.

(ii) Due to its modular construction it can be used to provide any desired length of ladderway. Longer lengths, in particular, are simpler and easier to install.

(iii) Because the system is manufactured of predominantly plastics materials it will not corrode like prior art steel ladderways.

(iv) The tube of the ladderway system provides improved safety and comfort for personnel and also protects the ladder from groundwater and seepage.

(v) It is relatively inexpensive to manufacture and can be assembled and installed without the need for expensive welding equipment.

It will be readily apparent to persons skilled in the relevant arts that various modifications and improvements may be made to the foregoing embodiments, in addition to those already described, without departing from the basic inventive concepts of the present invention. For example, whilst the preferred embodiment is of modular construction, to permit prefabrication and transport, this is not essential to the inventive concept, which also includes within its scope a ladderway system in which the tube, for example, is of unitary construction and extends the full length of the raise. Therefore, it will be appreciated that the scope of the invention is not limited to the specific embodiments described and is to be determined from the appended claims.

The claims defining the invention are as follows:

1. A ladderway system for an underground raise, the system comprising:

a plurality of elongate tubes configured to be joined end to end in the raise, each tube being a single annular piece formed of a lightweight resilient plastics material and configured to generally conform to the raise, where said elongate tube is of circular cross-section and is formed with a longitudinal slit along its entire length whereby the width of the slit is adjustable to conform the diameter of the tube can be adjusted to generally conform to the shape of the raise;

each tube having a ladder in an interior of the tube and extending substantially the full length of the tube, and wherein the ladder in each tube is provided with a joining device configured to join with the ladders in adjacent tubes end to end, wherein the ladder is received in a gap formed between the edges of the longitudinal slit and pushes the tube outwards to conform to the shape of the raise, and;

a mounting device in at least one of the tubes which is configured to mount the ladder and the tube to a wall of the raise, wherein the tube is configured to form a liner for the raise to protect a person on the ladder, and wherein each tube with the ladder in the ladderway system is prefabricated and the tubes with ladders are configured to be installed in the raise by connecting each tube and ladder to an adjoining tube and ladder, and sliding the connected tubes in the raise until the full length of the raise is lined.

2. A ladderway system as defined in claim 1, wherein each of said tubes is tapered at one end so that the ends of adjacent tubes can overlap when joined end to end.

3. A ladderway system as defined in claim 1, wherein said mounting device is provided in connection with the ladder.

4. A ladderway system as defined in claim 1, wherein the ladder locks the tube in place.

5. A ladderway system for an underground raise, the system comprising:

an elongate tube formed as a single annular piece from a plastic material, wherein the elongate tube is configured to generally conform to an interior sidewall of the raise, wherein the tube has a lateral slit extending the length of the tube, and the slit allows the tube to be compressed to the first diameter, and, wherein said tube has a first diameter when the tube is compressed for insertion in the raise and a second diameter, wider than the first diameter, when the tube is inserted in the raise;

a ladder extending substantially a full length of the tube and mechanically coupled to an interior of said tube when the tube has the second diameter, wherein the ladder is received in the slit and the ladder fixes the tube to a second diameter;

a mounting bracket fixed to the ladder, and an anchor configured to extend through the mounting bracket, the tube and into the sidewall of the raiser, wherein the mounting bracket and anchor are configured to mount the ladder and the tube to the sidewall of the raise.

6. The ladderway system as in claim 5 wherein the tube in the second diameter is configured to abut the sidewall and form a liner for the raise.

7. The ladderway system as in claim 5 wherein the anchor is a bolt.

8. The ladderway system as in claim 5 further comprising a second elongated tube mounted to an end of said elongated tube, and a second ladder mechanically coupled to the second elongated tube, and a second mounting bracket and a second anchor assembly configured to mount the second ladder and second elongated tube to the sidewall of the riser.

9. The ladderway system as in claim 5 wherein the elongate tube has a substantially constant diameter, such that the entire length of the tube is at the first diameter when the tube is compressed and the entire length of the tube is at the second diameter, when the tube is uncompressed and in the riser.

10. The ladderway system as in claim 5 wherein the ladder is mechanically coupled to the tube when the tube has the first diameter.

* * * * *

UNITED STATES PATENT AND TRADEMARK OFFICE

CERTIFICATE OF CORRECTION

PATENT NO. : 8,177,028 B2
APPLICATION NO. : 11/720811
DATED : May 15, 2012
INVENTOR(S) : Steven Durkin It is certified that error appears in the above-identified patent and that said Letters Patent is hereby corrected as shown below:

In the Claims:

In Claim 1 at column 7, line 3, delete "of the tube can be adjusted to generally conform to the" and insert --of the tube to generally conform to the--

Signed and Sealed this
Second Day of July, 2013

Teresa Stanek Rea
*Acting Director of the United States Patent and Trademark Office*